United States Patent [19]

Steffen et al.

[11] Patent Number: 4,773,609

[45] Date of Patent: Sep. 27, 1988

[54] AUTOMATIC REEL LOADING SYSTEM FOR WINDING APPARATUS

[75] Inventors: Andre Steffen; Claude Kleitz; Bernard Riegger, all of Strasbourg, France

[73] Assignee: Monomatic S.A., Strasbourg-Koenigshoffen, France

[21] Appl. No.: 45,577

[22] Filed: May 4, 1987

[30] Foreign Application Priority Data

May 9, 1986 [FR] France ..... 86 06810

[51] Int. Cl.[4] ..... B65H 19/02

[52] U.S. Cl. ..... 242/68.4; 242/57

[58] Field of Search ..... 242/68.4, 58, 57, 79

[56] References Cited

U.S. PATENT DOCUMENTS

| | | | |
|---|---|---|---|
| 2,973,914 | 3/1961 | Beninger | 242/58 |
| 3,321,147 | 5/1967 | Martin . | |
| 3,404,850 | 10/1968 | Merrill | 242/68.4 X |
| 3,415,459 | 12/1968 | O'Brien | 242/79 |
| 3,547,365 | 12/1970 | Loase | 242/64 X |
| 3,844,502 | 10/1974 | Toy, Jr. | 242/68.4 X |
| 4,131,206 | 12/1978 | Kawada et al. . | |
| 4,460,135 | 7/1984 | Hirakawa | 242/68.4 |

FOREIGN PATENT DOCUMENTS

| | | |
|---|---|---|
| 2098606 | 3/1972 | France . |
| 58-216853 | 12/1983 | Japan . |
| 1143593 | 2/1969 | United Kingdom . |
| 2106875 | 4/1983 | United Kingdom . |

*Primary Examiner*—Stuart S. Levy
*Assistant Examiner*—Katherine Matecki
*Attorney, Agent, or Firm*—Young & Thompson

[57] ABSTRACT

The present invention concerns an automatic reel loading system for winding apparatus. The system is composed of a reel diameter detector (4) operating just in front of the reel stand itself, a pulse generator (5) connecting the height detector (4) and to a central computer (6) comparing the number of pulses issued by the generator (5) to the number of pulses issued by a second pulse generator (7) driven by a gear working with the teeth of the periphery of the reel turnover plates (8) and thus determining the angular position of these turnover plates (8) and the position of the arms (9) and of the centering heads (10) fit at the free ends of these arms, until the latter heads are aligned with the axis of the reel core (11) so as to be seized by them, the arms (9) being guided by at least one guiding means (12) mainly composed of a rail which can be vertical or curved provided it helps the free end of the reel stand arm (9) reach a position where the centering heads (10) are perfectly aligned with the core of the new reel (11).

10 Claims, 5 Drawing Sheets

7
23
8
14
15
3
13
17
9
10
11
18
2
1
6
5
4
11
9
9
12
13
15
14
3
8
7
17
23

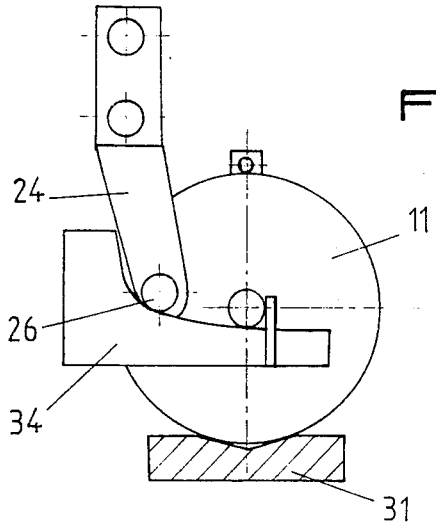
Fig. 7
Fig. 8
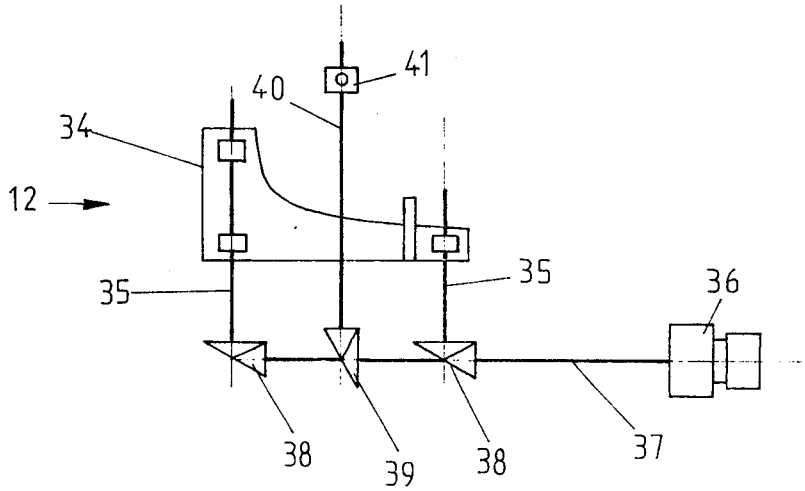

AUTOMATIC REEL LOADING SYSTEM FOR WINDING APPARATUS

The present invention relates to machines for unwinding webs from reels, particularly in nonstop operation, in order to feed various printing, coating, converting, or combined presses. It comprises means for automatically loading new reels onto such unwinders.

Up to now, the loading operation began with a forklift or the like, which laid a new reel in front of the unwinding arms; thereafter, an operator who controlled the delicate loading operation proper, i.e. bringing the reel centering heads of the above-mentioned arms right in front of the reel core, then seized it and lifted the reel to allow the unwinding. This loading method has several drawbacks. It requires significant space in front of the machine. Moreover, these operations are dangerous, particularly in case of large and heavy reels, as they are performed by the operator himself in this area.

Another known reel loading system consists of a transport carriage, also able to feed one or two unwinders disposed symmetrically in this system. It comprises a rolling cradle guided in rails laid in the floor. This cradle receives the reel from a forklift at one end, then takes this reel in front of one or the other unwinder. There, a sort of removable bumper can push the reel towards its final loading position.

The above-mentioned cradle assembly also can be pivotable on its rolling base: a hydraulic cylinder can lift one of its sides, thus forcing the reel to roll out towards the unwinder. In a second step, the unwinding arms are moved forward in order to let their centering heads approach the core of the reel.

The latter centering operation has to be very carefully controlled at each step by the operator or alternatively by one or several photoelectric scanners integrated in the unwinding heads and adapted to pass a beam through the hollow core.

In the first case, the operation is long and dangerous, particularly in the case of very large reels. In the second case, the safety conditions are satisfactory but the precision may suffer when the insides of reel cores made of cardboard are damaged, as is often the case due to repeated use.

The present invention seeks to overcome these disadvantages.

Specifically, it can be defined as a fully automatic and safe loading system. It receives reels from a transport carriage at a predetermined location near the unwinder; then it measures the height of the new reel with a height gauge linked to a pulse-meter which transmits the value of this measurement to a computer.

This computer will compare this number of impulses to another series of pulses coming from a second pulse generator geared to one of the reel turnover plates or discs of the reel stand. This second pulse generator is adapted to measure the turnover movement of the reel stand, and subsequently of the pair of arms fitted with reel centering heads, until these latter coincide with the center of the reel core. At the end of this approach, a guiding rail will decisively lead the above-mentioned unlocked arms along a specific line to lead the axis of the heads precisely toward the reel core.

The invention will be better understood from a reading of the following description of several preferred embodiments given as non-limiting and taken in conjunction with the accompanying drawings, in which:

FIG. 7 is similar to FIGS. 3 and 5, and shows another embodiment of the design for invention; and FIG. 8 schematically depicts moving means for the guiding rail according to FIG. 7.

Figure 1:
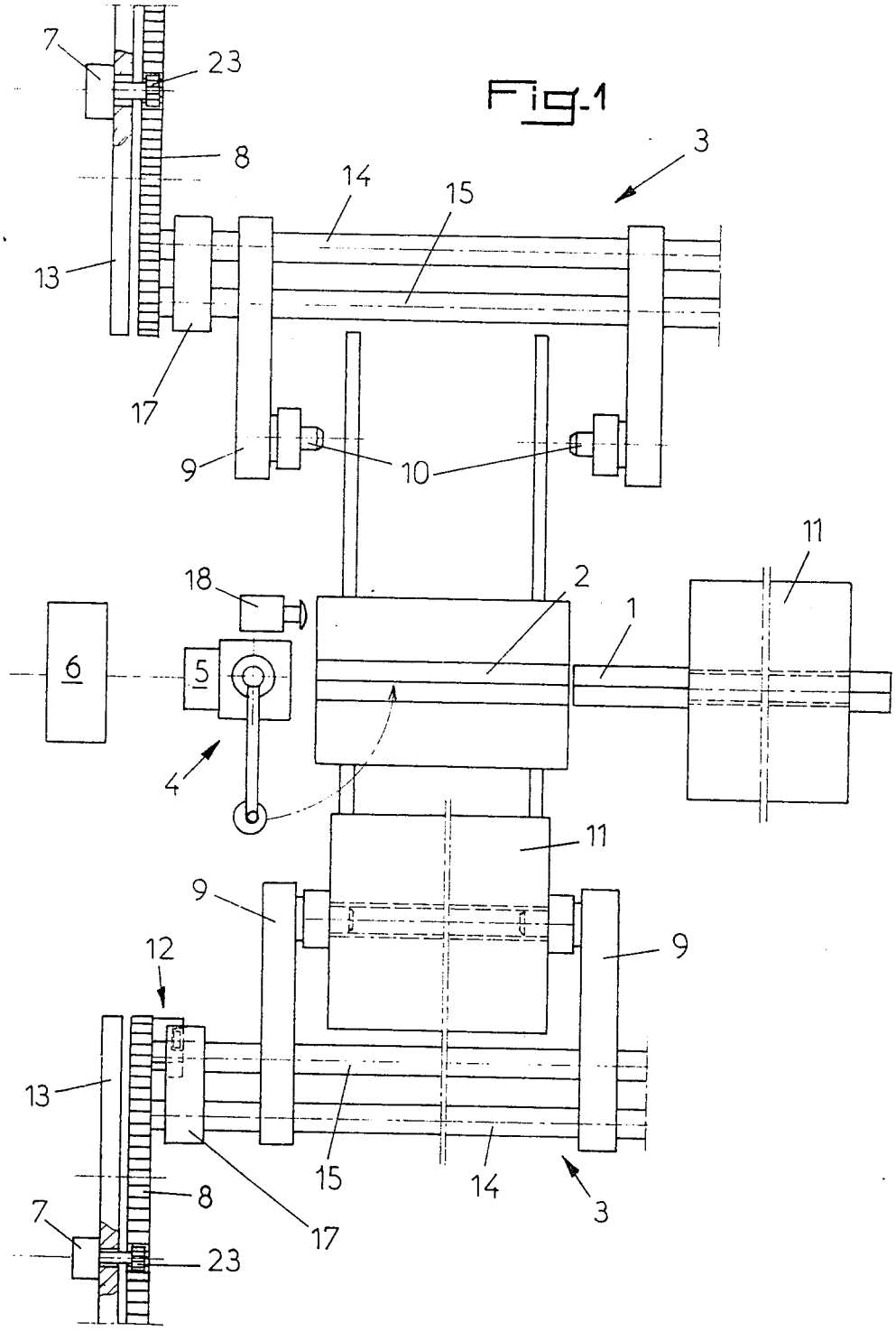
FIG. 1 is a view of the system according to the invention.
Figure 2:
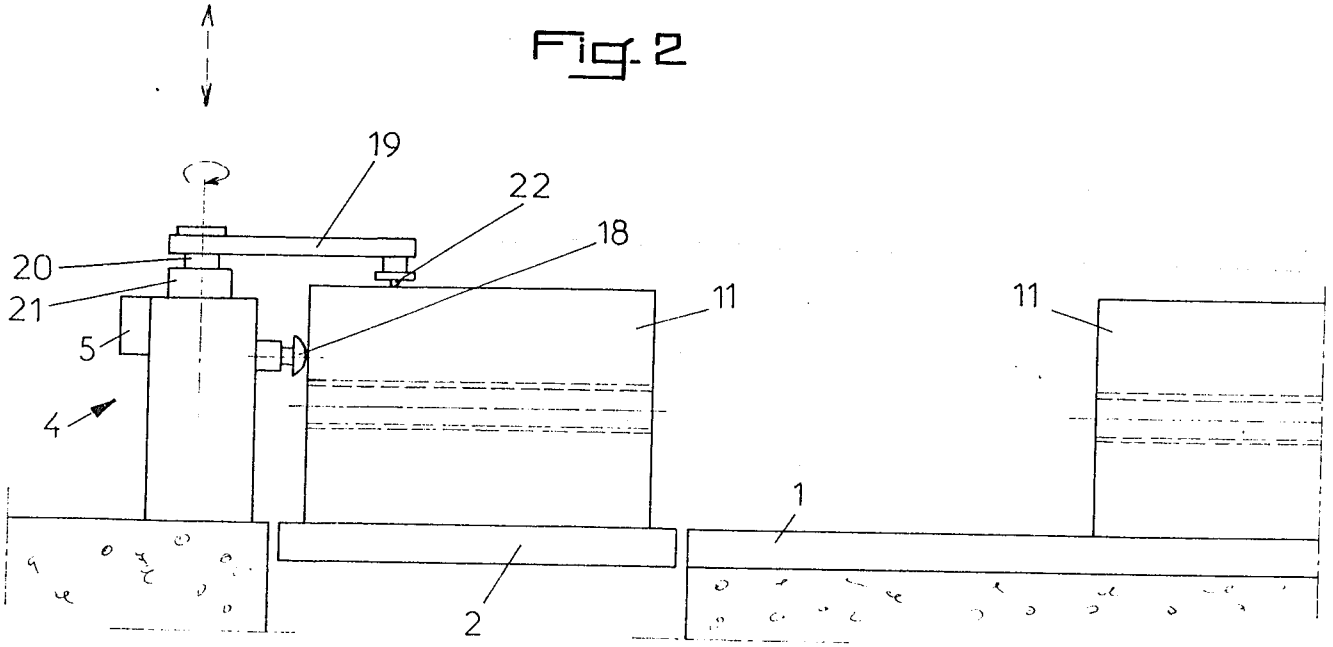
FIG. 2 is a side view of the reel height detector.

FIG. 1 shows a partial view of two reel stands 3 for the continuous unwinding of paper reels 11 or the like. These reel stands are disposed symmetrically about an unloading unit 2, fed with reels 11 from a transport system 1, assisted for example by a forklift. Each of these machines 3 have a basic frame 13 in which two turnover plates or discs 8 (parallel to each other and interconnected by beams 14) can rotate on suitable bearings.

These beams 14 have a round section and a smooth surface, and therefore serve well to assist the free swiveling and translation of the arms 9 across the width of the machine. An additional beam 15 is adapted rigidly to interconnect the pair of arms 9 together with the body of the turnover plates 8 by means of suitable locking pistons fit to these plates. Moreover, the position of the arms 9 relative to the beams 14 and 15 can be changed by a long drive screw 16 driven at one of its ends by an electric or pneumatic motor with a reduction gear 17 fit to the beam 14 by a free-swiveling assembly (see FIGS. 4 and 6).

According to the present invention, the loading system also includes a reel height detector 4 that operates before the reel reaches the reel stand proper. It comprises a detector head, the movement of which is geared to a pulse generator 5. The latter sends its pulses to a central computing unit 6 which compares them to those issued by a second pulse generator 7 geared to the teeth of one of the reel turnover plates 8. Each reel stand 3 has such a pulse generator 7, which ensures that the position of the centering heads 10 is always precisely indicated and registered, thus allowing the control of their satisfactory approach towards the reel core. At the final stage of this approach, the free ends of the arms 9 are guided by at least one vertically disposed rail 12 as shown in FIGS. 3 , 4, 5 or 6, but which can adopt any shape corresponding to the desired movements.

The reel transport system 1 is known per se: widely used are either a small carriage rolling between rails mounted on the ground, or a sort of heavy-duty chain running at floor level, able to bear a reel on any one of its links. Advantageous designs include switching points, or lateral reel ejectors, and ultimately a limit-switch 18, which can control the transport means to stop once the reel has reached the position 2.

The reel height detector according to the invention can for example be made of a horizontal arm 19, pivotable on a vertical shaft 20. The latter can glide in or along a vertical column 21 under the control of a fixedly mounted pulse generator 5. When the arm 19 moves from its initial reference position towards the reel body in order to measure its diameter, this movement will be stopped when the microswitch 22 touches the periphery of the reel.

The output from the pulse generator 5 will be a measure of the vertical travel of the shaft 20 along the column 21.

The second pulse generator 7 can be fitted with a gear wheel 23 geared to the toothed periphery of the turnover plate or disc 8, the rotation of which is controlled by a central computer 6. As soon as the latter computes an equivalence of the pulse signals generated first by 5 and then by 7, it will stop the movement of the turnover plates 8.

Of course the computing program calculating this equivalence can be more or less sophisticated depending on the chosen logic and precision range. But in any case, it allows in a first step to measure the diameter of the new reel, and in a second step to move the reel stand arms and centering heads accordingly, through a proportional and controlled course of the turnover plates, which will bring these heads right in front of and in alignment with the reel core.

The system 12 for vertically guiding the arms 9 comprises a lever 24 fastened to the casing of the reduction gear 17 which drives the long screw 16 for the lateral positioning of the arms 9 across the machine. Consequently, these levers 24 will swivel conjointly with the arms 9 about the beams 14.

Figure 3:
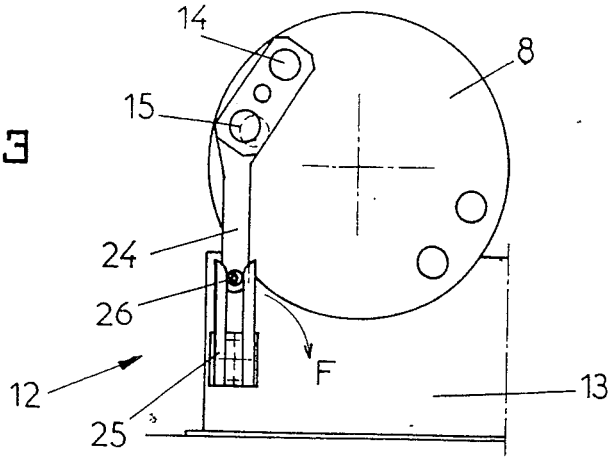
FIG. 3 is a partial side view of one vertical guiding system for a reel stand arm.
Figure 4:
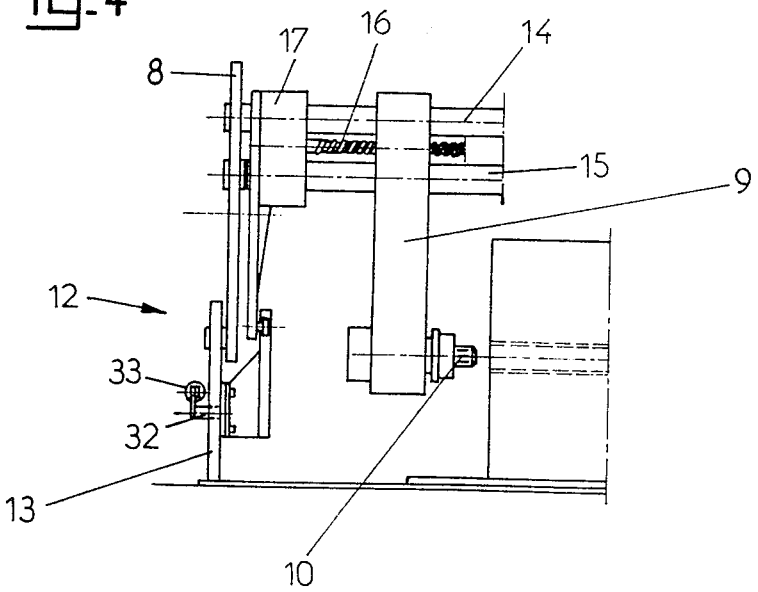
FIG. 4 is a partial side view of the guiding system shown in FIG. 3.

At the free end of this lever 24, a wheel 26 is mounted so as to roll in guiding rails 25 fastened to the base frame 13 of the winding apparatus 3. As can be seen in FIGS. 3 and 4, these guiding rails are removable from their position towards a resting end of course position, because they can rotate on a shaft 32, the angular position of which can be changed either by a manual lever, or by a jack controlled by the general computer of the loading system.

Therefore, when the overall loading procedure commences, the guiding rails 25 will first be moved forward into their active position (see FIGS. 3 and 4). At the end of the procedure, i.e. after the reel has been seized by the reel stand arms 9 and positioned until the locking of the beam 15 is complete, the guiding rails 25 will then swing back in order to allow a free passage of the lever 24 during the turnover of the reel stand plates 8.

Figure 5:
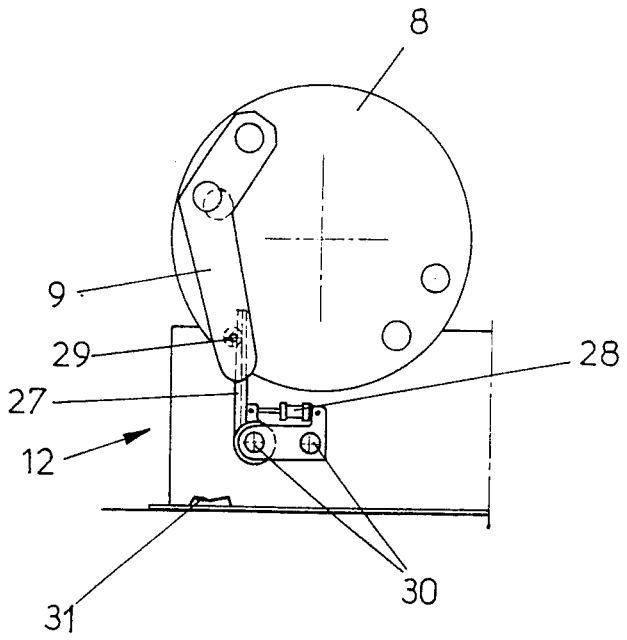
FIGS. 5 and 6 are similar to the FIGS. 3 and 4, and show another embodiment of guiding system.
Figure 6:
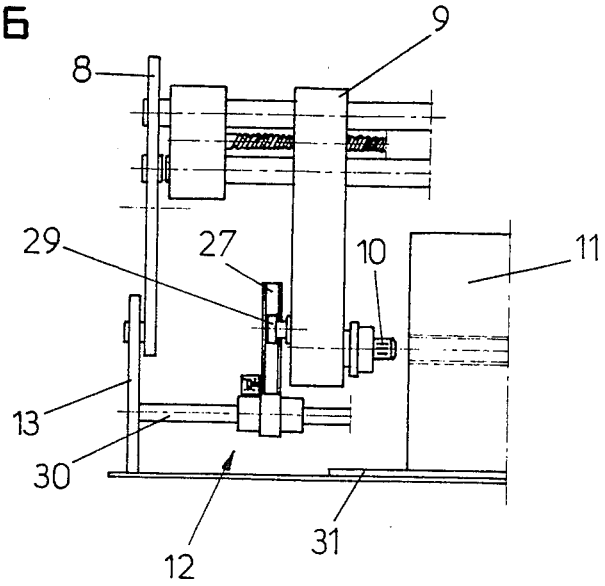

FIGS. 5 and 6 show another embodiment of the guiding system 12, wherein the guiding rail 27 is mounted on a carriage assembly sliding on two shafts 30. As can be seen in FIG. 6, the whole carriage of the guiding rail will follow any lateral movement of the reel stand arms 9 due to the U-shaped section of the rail 27 which confines the wheel 29. As in the previous embodiment, the guiding rail can swing out (or back) by means of an incorporated Jack 28. When the computer sequences orders, it will swing out and attain a vertical position, so as to conduct the small wheel 29 at the free end of the unlocked arms 9 and thereby let the axis of the reel-centering heads slowly move down in the same geometrical plane containing the reel core axis and the centerline of the reel cradle 31.

Thus, after the calculated turnover movement of the reel stand arms 9 is completed and the centering heads 10 have been brought into exact alignment with the core of the reel 11, the motorized gearbox 17 will drive the long screw 16 to move the arms 9 sideways to seize the reel 11.

As shown in FIGS. 7 and 8, the principle of the straight guiding rail 25 of FIG. 5 can be applied to a curved rail 34 acting with a wheel 26 fit to the free end of a lever 24 fixed to the reduction gearbox driving the long screws for the sideways adjustment of the reel stand 9 (not shown).

The entire curved rail 34 can be moved up or down by mechanical means described below, i.e. by the same drive 36 simultaneously moving a photoelectric scanner 41 or by any other means able to detect the height of the reel 11, provided that this scanner moves in the same vertical plane as the one including the axis of the new reel 11 waiting to be seized.

The motor with reduction gearbox 36 drives for example a shaft 37 connected to two successive angle gearboxes 38, each one driving a vertical screw 35, these twin screws controlling the vertical movements of the rail 34. The same shaft 37 is also connected to a third angle gearbox 39 which also drives a vertical screw 40, on top of which a nut assembly block supports a photoelectric scanner 41. The latter angle gearbox 39 has a gear ratio twice that of the ratio of the other two angle gearboxes 38, because the target of this scanner is the top of the reel body, whereas the guiding rail should aim to the center of the reel at half diameter level.

This embodiment of the guiding system 12 provides mechanical means to progressively and precisely guide the centering heads 10 of the arms 9 in front of the axis of the core of the reel 11.

In practice, the guiding system of FIGS. 7 and 8 operates as follows:

Once the new reel 11 has been conveyed on its cradle or fixed reference groove 31, the motor 36 is switched on and drives the shaft 37 and associated gearboxes 38 and 39, which in turn will drive the screws 35 and 40.

At the start of this procedure, the rail 34 and the photoelectric scanner 41 are advantageously in their lowermost position. As the angle gearbox 39 transmits twice the gear ratio as angle gearbox 38, the photoelectric scanner 41 will move at twice the speed as the rail 34 and the length of travel of the photoelectric scanner 41 will be double compared to the length of travel of the rail 34. Ultimately, when the beam of the photoelectric scanner 41 detects the top of the periphery of the reel and thus its diameter level, it will immediately order the drive motor 36 to stop. Consequently it will also stop the upwards movement of the rail 34. The part of this rail situated in the same vertical plane as the reel axis and as the reference groove 31, will thus be at the appropriate level for guiding the wheel 26 and the lever 24 and arms 9 such that the centering heads 10 can come exactly in front of the reel core axis and then can be introduced properly in this core in order to seize the reel 11.

Finally, the last sequence will order the driving of the reel stand turnover plates or discs 8 to return, which will also retract the attached arms 9. These latter, carrying with them the reel, will thus complete the reel loading operation.

Thanks to this invention, it is possible to feed winding apparatus fully automatically, allowing as it does a perfectly controlled and safe handling, centering and loading of the reels.

Of course, the invention is not limited to the embodiments described above and shown in the accompanying drawings. Modifications remain possible, particularly from the point of view of various constitutive elements, or by the substitution of technical equivalents, without departing from the scope of protection of the invention.

What is claimed is:

1. In an apparatus for handling reels of stock material, comprising a pair of movable arms having aligned means for embracing opposite ends of a said reel, means for measuring the diameter of a said reel, and means for effecting relative vertical movement between a said reel and said embracing means, responsive to said measuring means, to position a said reel coaxially between said aligned embracing means, the improvement in which said means for effecting relative movement comprise a pair of spaced-apart coaxial turnover plates mounted for conjoint rotation about a common axis, said pair of arms being eccentrically mounted between said pair of plates for movement therewith and for conjoint pivotal movement about a second axis parallel to and spaced from said common axis, and means for guiding said aligned reel embracing means to any selected position in a predetermined vertical plane.

2. Apparatus according to claim 1, further comprising a first beam rigidly interconnecting said pair of turnover plates, said first beam extending parallel to and spaced from said common axis, said pair of arms being pivotally mounted on said first beam.

3. Apparatus according to claim 2, further comprising a second beam interconnecting said pair of arms, said second beam extending parallel to and spaced from said first beam and said common axis.

4. Apparatus according to claim 1, further comprising means for moving one of said aligned embracing means in a direction parallel to said common axis.

5. Apparatus according to claim 1, wherein said guiding means comprises: a lever mounted for movement with said pair of arms at least in a plane perpendicular to said common axis, said lever having a free end comprising a roller; and a guide rail dimensioned and disposed to receive said roller and thereafter to effect said guiding.

6. Apparatus according to claim 5, wherein said means for measuring the diameter of a said reel comprises a first pulse generator outputting pulses as a measure of reel diameter, and said means for effecting relative vertical movement between a said reel and said embracing means comprises: a second pulse generator outputting pulses as a measure of rotation of said pair of turnover plates; and means for comparing pulses generated by said first and second pulse generators and stopping rotation of said pair of turnover plates when said comparing means detects that said turnover plates have rotated an extent corresponding to said reel diameter; said guide rail being straight and movable to a vertical position at which it is effective to effect said guiding upon receipt of said roller.

7. Apparatus according to claim 6, wherein at least one of said pair of turnover plates has a toothed periphery meshing with a toothed drive pinion, said second pulse generator outputting pulses as a measure of rotation of said toothed drive pinion.

8. Apparatus according to claim 5, wherein said means for measuring the diameter of a said reel comprises a photoelectric scanner, means for displacing said scanner vertically in said predetermined vertical plane adjacent a said reel whose diameter is to be measured, said displacing means also displacing said guide rail in the form of a vertically displaceable rail having a curved guiding surface, and power transmission means drivingly disposed intermediate said displacing means and said scanner and said rail, said transmission means causing said displacing means to displace said scanner at a rate twice that of said rail, whereby stoppage of said displacing means when said scanner detects the upper periphery of a said reel in said predetermined vertical plane positions said rail so as to effect said guiding.

9. Apparatus according to claim 1, further comprising a reel loading station having means for receiving a said reel in a predetermined orientation, such that the axis of said reel lies in said predetermined vertical plane, regardless of the diameter of said reel.

10. Apparatus according to claim 1, further comprising means for fixing said pair of arms against said conjoint pivotal movement about said second axis

* * * * *